United States Patent [19]

Dziark et al.

[11] Patent Number: 4,470,719

[45] Date of Patent: Sep. 11, 1984

[54] METHOD FOR REPAIRING OR PREVENTING FAULTING ON CONCRETE HIGHWAYS

[75] Inventors: John J. Dziark, Ballston Spa; Robert L. Nelson, Troy; Alfred G. Sanford, Cohoes, all of N.Y.

[73] Assignee: General Electric Company, Waterford, N.Y.

[21] Appl. No.: 339,473

[22] Filed: Jan. 15, 1982

[51] Int. Cl.[3] ..... E01C 23/10; E01C 3/06

[52] U.S. Cl. ..... 404/75; 404/47; 404/74; 404/78; 52/514

[58] Field of Search ..... 404/78, 75, 74, 72, 404/49, 47; 521/123, 117; 52/743, 744, 514

[56] References Cited

U.S. PATENT DOCUMENTS

| | | | |
|---|---|---|---|
| 1,401,974 | 1/1922 | Fischer | 404/74 X |
| 1,976,857 | 10/1934 | Poulter | 404/78 |
| 2,728,734 | 12/1955 | Cubberley et al. | 260/28.5 |
| 3,425,967 | 2/1969 | Modic | 521/123 |
| 3,524,390 | 8/1970 | Dill | 404/49 |
| 3,626,702 | 12/1971 | Monahan | 404/28 X |
| 3,844,128 | 10/1974 | Harrison | 404/78 X |
| 3,880,538 | 4/1975 | Burt | 404/28 |
| 3,923,705 | 12/1975 | Smith | 521/117 |

*Primary Examiner*—James A. Leppink
*Assistant Examiner*—Beverly E. Hjorth
*Attorney, Agent, or Firm*—Hedman, Gibson, Costigan & Hoare

[57] ABSTRACT

A method is provided for repairing or preventing the faulting phenomenon in unreinforced concrete highways. Flowable, foamable, curable compositions are injected into the transverse joint between concrete slabs to fill any voids that exist between or under the slabs, and to fix loose incompressible "fines" which are forced beneath the slabs.

21 Claims, 3 Drawing Figures

METHOD FOR REPAIRING OR PREVENTING FAULTING ON CONCRETE HIGHWAYS

This invention relates to methods for repairing and maintaining unreinforced concrete highways.

BACKGROUND OF THE INVENTION

Modern highways are typically constructed of end-to-end slabs of unreinforced concrete which are laid over an asphaltic or concrete sub-base. The concrete is laid in slabs, leaving transverse joints which will allow the concrete to expand and contract with seasonal and daily temperature changes. The transverse joints are usually sealed with resilient materials such as oxidized asphalt, rubberized asphalt and preformed neoprene. They are adapted to expand and contract with the concrete and function to prevent the introduction of ground water, sand and other materials into the joint that may interfere with its function.

In addition to longitudinal expansion and contraction, the concrete slabs also curl in conjunction with daily temperature swings. The curling is caused by temperature differences occurring between the top and the bottom of the slab such as occurs each evening after sundown or each morning following sunrise. When the concrete slabs are in a concave configuration (i.e., the ends of the slabs are curled up), a void occurs between the bottom of the slab and the sub-base.

The dimished sub-base support at the joints causes a pumping action when traffic passes over the distorted slabs, and this has the effect of forcing "fines", such as sand, clay, etc., under the ends of the respective slab or slabs. The incompressible fines cause the joint to be fixed in a faulted position, leading to a rough ride for vehicular traffic and eventual cracking at the slab ends. Grinding of the fines under the pavement may also erode the sub-base.

Attempts to solve the faulting problems in highways by pumping materials which harden under the slab have proved ineffective. Conventional sealants are too viscous to fill the void, too hard, or are not flexible enough to follow the movements of the concrete.

It has now been discovered that pumping flowable, curable compositions of a type which cure to resilient and flexible foams solves the problem of repairing damaged highways, and this is a major object of the present invention.

Also, in another aspect of the present invention, before the slabs in new construction have had a chance to distort, the fines can be prevented from entering the areas adjacent the transverse joints by injecting such compositions to form a foamed barrier.

BRIEF DESCRIPTION OF THE DRAWINGS

The invention can be better understood by reference to the drawings in which.

SUMMARY OF THE INVENTION

Figure 1:
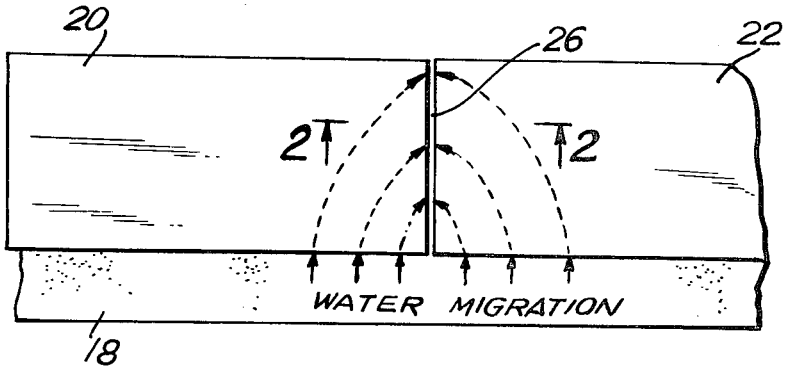
FIG. 1 is a plan view looking down onto a portion of a highway constructed from two slabs of concrete separated by a transverse joint, showing the pattern of ground water migration which carries fines under the slabs.

According to the present invention there is provided a method for repairing or preventing faulting in concrete highways comprising a sub-base and overlying said sub-base, an approach slab, a leaving slab, and a transverse joint between the slabs, which method comprises:

(1) providing a flowable, foamable, curable composition which cures to a flexible and resilient foam;

(2) injecting said composition under said approach slab and/or leaving slab to substantially completely fill any void which might be in open communication therewith and located between either or both of said slabs and said sub-base; and (3) allowing said composition to foam and cure.

In preferred aspects, the sub-base comprises concrete or asphalt, the approach slab and the leaving slab comprise concrete.

In special features the transverse joint is in open communication with voids between the slabs and the sub-base and the voids contain small, particulate fines; the particulate fines comprise sand, clay or a mixture thereof; and the flowable, foamable, curable composition is capable of imbibing said fines and, after curing step (3), said fines are bound into the foamed and cured composition.

Preferred features are those in which the composition is capable of curing in less than one hour at temperature of from about 15° C. to about 50° C.; has a viscosity in the range of 1,000 to 15,000 centipoise at 25° C.; and tolerates moisture during cure.

As to the preferred composition, there are contemplated elastomeric foams, especially foamable silicone compositions, and especially preferably foamable elastomeric silicone compositions.

Special mention is made of foamable compositions which comprise a vinyl-containing polysiloxane, a compound containing silicon-hydrogen bonds and a platinum catalyst and optionally, a silanol-containing compound, and in all cases if the compositions expand as they cure, and if they bond to the materials of construction, this is often desirable.

Of particular interest herein are foamable compositions having set times of fifteen minutes or less at room temperature, free foam density of about 23–27 lbs./ft$^3$, shelf lives of a year or longer, closed cell structure, and which absorb water to about 5–10% by weight.

Although a free foam density of about 23–27 lbs/ft$^3$ is of particular interest in the method of this invention, foams useful in the invention are not limited to this density range. Densities as low as about 18 lbs/ft$^3$ may be suitable and even lower densities can be considered. Densities of foams of about 36 lbs/ft$^3$ or higher could also be useful but of necessity require a greater quantity of material to fill a given space.

DETAILED DESCRIPTION OF INVENTION

The method of this invention provides a way to repair and prevent faulting in unreinforced concrete highways. It involves injecting a curable, flowable material under the concrete slab surface layer of the roadbed so that after curing it fills any voids present under the concrete slabs and blocks the introduction of fines under the slabs.

The materials which are suitable for use in the method of this invention must have a low enough viscosity, i.e., be flowable enough, to penetrate to all recesses of the void that may exist between the concrete slabs and the sub-base of the roadbed. They must also be curable in the presence of wet fines and be capable after curing of accommodating the routine slab movement without pumping out of the joint. The cured material must finally be resilient enough not to deteriorate under the forces encountered under and between the concrete slabs.

Among the many compositions which meet the above requirements are foamable plastics, which are preferred. Among them are urethane foams, rubber foams, neoprene foams, polysulfide rubber foams, and the like. Most preferred are silicone foams, such as those described in U.S. Pat. Nos. 3,425,967 (Modic) and 3,923,705 (Smith), and especially commonly assigned copending U.S. application Ser. No. 103,881, filed Dec. 17, 1979. These patents and applications are incorporated herein by reference. The resiliency and excellent pot life of these materials makes them especially attractive.

Also, many of these silicone foams expand as they cure, which as above mentioned, is an added advantage in the present invention, where a concealed void must be filled.

Figure 3:
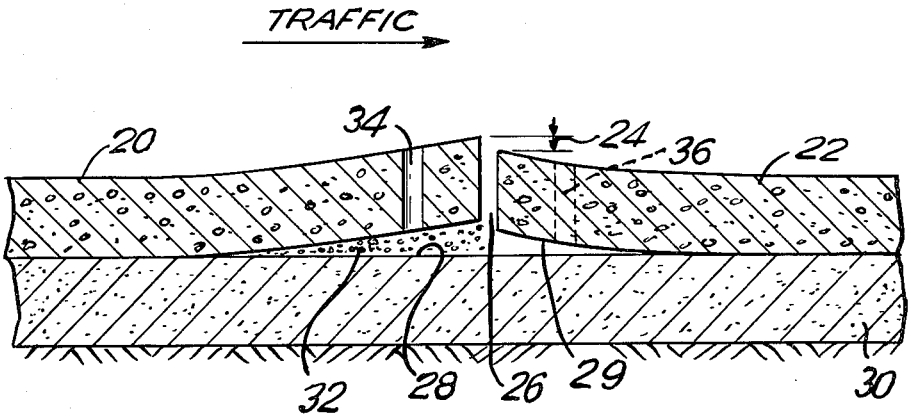
FIG. 3, like FIG. 2, is a side elevation of a section of highway, but in this case, also included are holes drilled through both slabs near the joint, and these represent an alternative means to introduce curable composition according to this invention.

In practice of this invention, the curable, flowable material selected is injected under the approach slab and/or the leaving slab and allowed to cure. Accurate placement of the foamable conposition is achieved if the injection is through holes drilled for this purpose through a slab (FIG. 3, reference numerals 34 and 36, respectively); however, all means and channels of introducing the foam under the slab or slabs is fully contemplated herein.

The cured material apparently blocks the introduction of fines beneath the slabs, and so eliminates faulting between the slabs.

In addition, if the fault contains fines, the composition should be selected to imbibe the fines so that after curing the fines are distributed in the composition and fixed in place. This avoids migration and moving of loose fines which as mentioned above may contribute to erosion of the sub-base.

It may also be advantageous for the foamable composition selected to contain additives which enhance the properties of the foam or make it more adaptable to the method of the present invention. Such additives include oils and dispersants which lower the viscosity of the foam and make it more flowable, inhibitors and catalysts which modify the set time of the foam, etc. Especially contemplated herein for use in conjuction with silicone foams are silicone oils, such as polydimethylsiloxane fluids for controlling viscosity, and inhibitors, such as methylvinyl cyclic tetramers for controlling the set time.

DESCRIPTION OF THE PREFERRED EMBODIMENTS

The following examples are illustrative of the methods employed in this invention but should not be construed as a limitation on the scope of the invention.

EXAMPLE I

Faulting is simulated on an apparatus developed by the California Department of Transportation in order to study the faulting phenomenon. Faulting is induced on a model roadbed comprising a concrete sub-base and two concrete slabs above said sub-base and separated by a transverse joint. The test conditions are induced by heating the sub-base with hot water coils and cooling the concrete road surface with ice. The transverse joint is then subjected to computercontrolled dynamic loads which simulate wheeled traffic.

Figure 2:
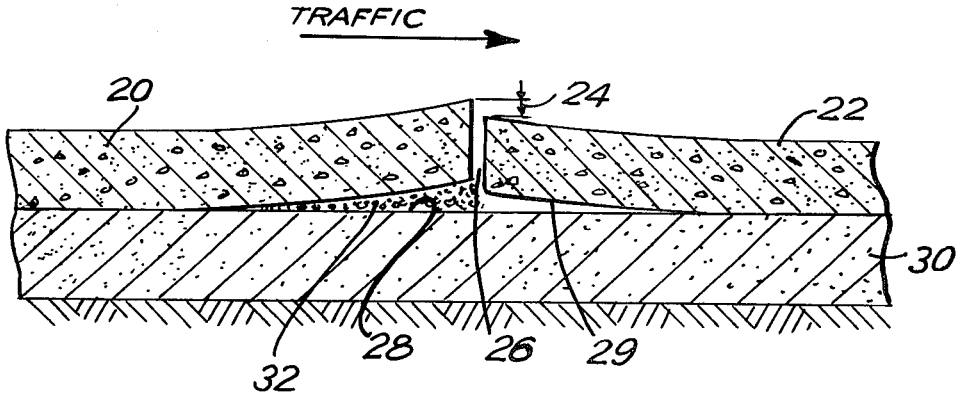
FIG. 2 is a side elevation view in section of a highway showing the "faulting" phenomenon. Incompressible "fines" have been pumped into the void under the approach slab adjacent to the transverse joint, resulting in a vertical displacement of the approach slab in relation to the leaving slab.

The general configuration of the model roadbed is shown in FIG. 2 with traffic direction indicated by the arrow. Approach slab 20 is concave upwardly and terminates a transverse joint 26. Leaving slab 22 begins at joint 26 and also is concave upwardly. Typically, there is a fault of 0.08 inches to 0.10 inches, designated by displacement reference 24. The corresponding voids are shown at 28 and 29. In the voids there can be fines which are particles of sand, clay or the like; in FIG. 2, fines 32 are shown under the approach slab 20. Into voids 28 and 29 is pumped a silicone foam composition with viscosity in the range of 1,000–10,000 cps at 25° C. and after filling the joint and voids, the composition is permitted to foam in place and cure at ambient temperatures for 60 minutes.

No faulting occurred in the test joint even after a million cycles when the following composition (Ser. No. 103,881, filed Dec. 17, 1979, Example 1) was employed:

| Components | Parts by Weight |
|---|---|
| Part A | |
| 72 pbw 0.0015% vinyl terminated dimethylpolysiloxane (3500 cs at 25° C.) | 49.4 |
| 28 pbw 0.0005% vinyl terminated dimethylpolysiloxane (80,000 cs at 25° C.) | |
| quartz filler (5 microns) | 7 |
| carbon black | 0.6 |
| platinum catalyst (Karstedt U.S. Pat. No. 3,775,452) | 12.5 (ppm) |
| linear dimethylpolysiloxane (contains 7.3% silanol) | 1 |
| methyl vinyl cyclotetrasiloxane | 0.09 |
| Part B | |
| hydrogen linear polysiloxane containing 1.5 percent of silicon-hydrogen bonds | 2 parts |

Two parts by weight are mixed with Part A immediately prior to pumping.

EXAMPLE II

If the procedure of Example 1 were to be repeated and if a foamable composition of Example 1 of U.S. Pat. No. 3,923,705 were to be substituted, it is expected that a concrete highway prototype repaired according to this invention would be obtained.

In Example 1 of U.S. Pat. No. 3,923,705 a silicone foam was prepared by hand mixing at room temperature 50 parts by weight of a phenylmethylvinylsiloxy endblocked polydimethylsiloxane having a viscosity of 12,500 cs. at 25° C., 10 parts by weight of a trimethylsiloxy endblocked polymethylhydrogensiloxane having about 1.5 weight percent silicon-bonded hydrogen atoms, 10 parts by weight of a hydroxyl endblocked polydimethylsiloxane having about 4 weight percent silicon-bonded hydroxyl radicals and 46 parts by weight platinum in the form of a chloroplatinic acid catalyst complex with symetrical divinyltetramethyldisiloxane containing about 0.65 weight percent platinum. The polymethylhydrogensiloxane was the last ingredient added to the mixture. The resulting mixture had a molar ratio of silicon-bonded hydrogen atoms (SiH) to silicon-bonded hydroxyl radicals (SiOH) of about 6.4 and began foaming almost before the mixing was completed. The resulting product was a cured, dry elastomeric foam.

EXAMPLE III

The following modified silicone foam composition was injected through 1¼-inch drilled holes, under the leaving slab of a model highway section using a pressurized Binks 18 FMP ® plural component gun:

| Material | Amount |
|---|---|
| GE 850 ® Silicone, components A and B[1] | 40 lbs. of each component |
| GE 96-50 ® Silicone Oil[2] | 10 lbs. with each component A and B, above |
| Gellation Inhibitor[3] | 45 grams added to component B |

[1]dual-component silicone foam, sold by General Electric Company.
[2]polydimethylsiloxane fluid, sold by General Electric Company.
[3]sym-tetramethyltetravinylcyclotetrasiloxane, sold by General Company.

A total of 22 holes, either 2 or 3 holes to a slab, were drilled. Sixteen of the holes were successfully filled with component injection pressures of from 35–45 PSIG. Slab lift from 0.003" to 0.008" was observed in a few of the slabs after injection. No slab movement was recorded.

EXAMPLE IV

A field test using the procedure of Example III was conducted on a 20-slab length of south-bound California highway. The adjacent north-bound section was monitored as a control.

52 holes were drilled in leaving slabs near the transverse joint, either 2 or 3 holes per slab. The silicone composition of Example III, but containing only 18 grams of inhibitor, was injected into the holes. Nine holes did not take any appreciable amount of silicone, but at least one hole in every slab accepted the material. An estimated total volume (Silicone+Silicone Oil) of 17 gallons was used, an average of 0.3 gallons per hole.

Faulting measurements indicated that the injection, plus the volume increase due to the foaming reaction, raised slabs (reduced faulting) by 0.014 inch.

In view of the foregoing disclosure, many variations of the particular embodiments will be apparent to persons skilled in this art. It is intended, however, that all such obvious variations be included within the scope of the appended claims.

We claim:

1. A method for repairing or preventing faulting in unreinforced concrete highways comprising a sub-base and, overlying said sub-base, an approach slab, a leaving slab, and a transverse joint between the slabs, which method comprises:

(1) providing a flowable, foamable, curable composition which cures to a flexible and resilient foam;

(2) injecting said composition under said approach slab, or said leaving slab, or both slabs to substantially completely fill any regularly recurring void which might be in open communication therewith and located under or between either or both of said slabs and said sub-base; and (3) allowing said composition to foam and cure, said cured composition being capable of accomodating normal slab movement without migrating from the void.

2. The method of claim 1, wherein said sub-base comprises concrete or asphalt.

3. The method of claim 1, wherein said approach slab and said leaving slab comprise concrete.

4. The method of claim 1, wherein said transverse joint is in open communication with voids between the slabs and the sub-base and the voids contain small, particulate fines.

5. The method of claim 4, wherein the particulate fines comprise sand, clay or a mixture thereof.

6. The method of claim 4, wherein said flowable, foamable, curable composition is capable of imbibing said fines and, after curing step (3), said fines are bound into the foamed and cured composition.

7. The method of claim 1, wherein said flowable, foamable, curable composition is capable of curing in less than one hour at temperature of from about 15° C. to about 50° C.

8. The method of claim 1, wherein said flowable, foamable, curable composition has a viscosity in the range of 1,000 to 15,000 centipoise at about 25° C.

9. The method of claim 1, wherein said flowable, foamable, curable composition tolerates moisture during cure.

10. The method of claim 1, wherein said flowable composition is adapted to produce an elastomeric foam.

11. The method of claim 10, wherein said composition is a foamable silicone composition.

12. The method of claim 11, wherein said foamable composition comprises a vinyl-containing polysiloxane, a compound containing silicon-hydrogen bonds and a platinum catalyst and optionally, a silanol-containing compound.

13. The method of claim 12, wherein said foamable composition has a closed cell structure.

14. The method of claim 11, wherein said foamable silicone composition has a closed cell structure, absorbs 5–10% by weight of water, and has a free foam density of 25±2 lbs/ft$^3$.

15. The method of claim 13, wherein said foamable silicone composition has a closed cell structure.

16. The method of claim 10, wherein said elastomeric foam has a closed cell structure.

17. The method of claim 1, wherein said composition is a foamable silicone composition.

18. The method of claim 17, wherein said foamable silicone composition has a closed cell structure.

19. The method of claim 1, wherein said flowable composition expands as it cures.

20. The method of claim 1, which also includes the preliminary step, before step (1) of drilling holes through either or both of said slabs to admit the curable composition.

21. The method of claim 1, wherein said foamable, curable composition has a closed cell structure.

* * * * *